US006844667B2

(12) United States Patent
Choi et al.

(10) Patent No.: US 6,844,667 B2
(45) Date of Patent: Jan. 18, 2005

(54) PANEL FOR CATHODE RAY TUBE

(75) Inventors: Jong-Tae Choi, Daegu (KR); Bum-Sik Seo, Seoul (KR)

(73) Assignee: Lg. Philips Displays Korea Co., Ltd., Kyeongsangbuk-Do (KR)

( * ) Notice: Subject to any disclaimer, the term of this patent is extended or adjusted under 35 U.S.C. 154(b) by 0 days.

(21) Appl. No.: 10/404,656

(22) Filed: Apr. 2, 2003

(65) Prior Publication Data

US 2004/0017146 A1 Jan. 29, 2004

(30) Foreign Application Priority Data

Jul. 29, 2002 (KR) ..... 10-2002-0044658
Jan. 21, 2003 (KR) ..... 10-2003-0004062

(51) Int. Cl.[7] ..... H01J 29/10

(52) U.S. Cl. ..... 313/461; 313/473; 313/479; 313/408; 445/11; 445/14; 359/893

(58) Field of Search ..... 313/461, 473, 313/479, 408; 445/11, 13, 14; 359/893

(56) References Cited

U.S. PATENT DOCUMENTS 5,643,033 A * 7/1997 Gnade et al. ..... 445/24
6,479,928 B1 * 11/2002 Lee et al. ..... 313/461

FOREIGN PATENT DOCUMENTS

JP 4-17237 A 1/1992
KR 93-12090 U 6/1993

* cited by examiner

*Primary Examiner*—Vip Patel
*Assistant Examiner*—Anthony Perry
(74) *Attorney, Agent, or Firm*—Birch, Stewart, Kolasch, & Birch, LLP

(57) ABSTRACT

A panel for a cathode ray tube having an inner surface with predetermined roughness, including a plurality of black matrix layers formed on the inner surface and a phosphor layer composed of red, green and blue phosphors between the black matrix layers, and the phosphor layer and the black matrix layer are formed on the inner surface of the panel after forming a transparent dielectric film, can prevent degradation of brightness and color purity of a screen caused as a result of grinding process which gives roughness to an inner surface of the panel in order to prevent mirror surface reflection on the inner surface of the panel caused by external light.

16 Claims, 6 Drawing Sheets

PANEL FOR CATHODE RAY TUBE

BACKGROUND OF THE INVENTION

1. Field of the Invention

The present invention relates to a cathode ray tube and particularly, to a panel for a cathode ray tube, capable of preventing degradation of brightness and color purity of a screen caused as a result of grinding process which gives roughness to an inner surface of the panel in order to prevent mirror surface reflection on the inner surface of the panel caused by external light.

2. Description of the Related Art

Generally, as shown in FIG. 1, a flat cathode ray tube includes a panel 1 having an inner surface and outer surface which are formed as a flat plane which is mounted on a front surface of the cathode ray tube, a screen film 2 which is coated on the inner side of the panel 1, a shadow mask 3 which has a function of filtering colors of the electron beam 8 injected to the screen film 2, a frame for supporting the shadow mask 3, a funnel 5 which is combined on the rear surface of the panel 1 and maintains a vacuum inside the cathode ray tube, an electron gun 7 which is mounted inside a neck portion 6 which is formed at the rear of the funnel 5, for emitting the electron beam 8, a deflection yoke 9 for deflecting the electron beam 8 which is emitted from the electron gun 7 and an inner shield 10 which is mounted at an inner side of the panel 1, for shielding affect of the external earth terrestrial magnetism when the electron beam progresses to the screen 2.

As shown in FIG. 2, in the screen film 2, a black matrix layer 11 which is made of graphite is formed as points which are positioned at a predetermined interval with a predetermined width or as a linear black matrix pattern 13 on the inner surface of the panel 1, and a phosphor layer 12 including blue 12*a*, green 12*b* and red 12*c* colors which are formed in a laminated structure while being overlapped in a predetermined region among the respective black matrix layers 11 or the upper portion, is sequentially coated at a predetermined interval. In addition, a metal layer 14 such as aluminum is deposited in the upper portion of the phosphor layer 12.

In the conventional cathode ray tube, the electron beam 8 generated in the electron gun 7 is deflected by the deflection yoke 9, and selectively reaches to the phosphor layer after passing the shadow mask 3, thus to have the respective phosphors 12*a*, 12*b* and 12*c* emit light. Then, the emitted light passes the inside of the panel 1 and implements a final screen on the front surface of the panel 1.

On the other hand, when a user looks into the screen of the image display device from the outside, external light L such as electric light and sun light is transmitted into the panel 1 from the outside, and the transmitted external light L causes external light reflection which is mirror surface reflection on the peripheral surface between the phosphor layer 12 which is coated on the inner surface of the panel 1 and the black matrix layer 11. Such external light reflection has a disadvantage of making eyes of the user looking at the displayed screen fatigued.

Also, in case surface roughness of the panel 1 on which the phosphor layer 12 is coated is low, degree of the external light reflection 15 becomes deepened and to solve this, the inner surface of the panel 1 must be mechanically ground and mirror surface reflection of the inner surface of the panel 1 caused by external light must be prevented by giving rougher inner surface of the panel 1. In addition, the external light must be scattered in order to reduce visual fatigue of the user looking at the displayed screen.

Here, to give a predetermined degree of surface roughness to the inner surface of the panel 1, a method of mechanically grinding a surface of the panel 1 with abrasive composed of fine powder particles having a predetermined hardness using a flat abrasive stone or abrasive pad is used as a method of grinding processing to give a predetermined degree of surface roughness to the inner surface of the panel 1.

In case the inner surface of the panel 1 is ground by the above method, the surface roughness becomes 1.5~2.5 $\mu$m for an evaluation length of 1 mm when measuring by a mean peak to valley height method (hereinafter, as Rz: DIN 4768/1). On the other hand, in case of processing with a lower range of roughness than the surface roughness value, that is, in case of processing with a surface roughness close to that of a mirror surface, abrasive with a smaller grain size must be used, and processing time must be increased, thus to increase manufacturing cost.

In case of processing the surface with a larger range of roughness than the surface roughness value, that is, in case of processing with a surface roughness gets out of that of the mirror surface, the cost is decreased. However, when the phosphor layer 12 which is directly coated on the inner surface of the panel emits light while the image display device is operated and transmits light from the inner surface to the outer surface of the panel 1, scattering of light is too extreme by high roughness of the inner surface of the panel 1, and the light transmission rate of the panel 1 is degraded, thus to degrade brightness of the image display device.

On the other hand, when a phosphor layer 12 is coated on an inner surface of the panel 1 having roughness higher than 1.5 $\mu$m, generally, an average grain size of the respective fluorescent particles which comprise the phosphor layer 12 is 5 $\mu$m or higher.

When the phosphor having the above grain size is coated on the inner surface of the panel 1, the phosphor layer 12 is formed by forming a periphery while being contacted on the mountain region on the inner surface of the panel 1 having a shape of the section formed as peaks and valleys which are sharp wave forms.

Therefore, since the size of the size of the section on the inner surface of the panel 1 is relatively smaller than the size of the average of the phosphor, the phosphor layer 12 is formed under the condition that the fluorescent particles is not infiltrated into the valley of the inner surface of the panel 1, thus to form a pore surface 16 which is an empty space between phosphor layer 12 and the inner surface of the panel 1.

The pore surface 16 promotes light scattering reflection inside the panel 1 when the phosphor emits light and the light progresses to the outer surface of the panel 1, and brightness of the image display device is degraded by reducing efficiency of transmitting light of the phosphor layer 12 through the panel 1.

On the other hand, in the process of forming the black matrix pattern 13, materials for forming the black matrix layer 11 composed of materials such as graphite and the like are entirely coated on the inner surface of the panel 1. Then, the surface is exposed by using a random pattern, and a final black matrix pattern 13 is developed by dividing the exposed part and the rest part.

The roughness of the inner surface of the panel 1 badly affects on adhesiveness between the coated graphite and the inner surface of the panel 1, and accordingly, it is difficult to develop the peripheral line as a line having clear straightness in developing the black matrix layer 11 after exposing. Therefore, cutting that the periphery lines among the black matrix patterns 13 and between the respective phosphor layer 12 and black matrix pattern 13 which are formed having a part overlapped thereon are formed as straight lines becomes degraded, thus to degrade quality corresponding to characteristics such as brightness and color purity of the image display device conclusively.

SUMMARY OF THE INVENTION

Therefore, an object of the present invention is to provide a panel for a cathode ray tube, increasing brightness of an image display device by forming a transparent dielectric film on the inner surface of a panel in order to transmit light to the outside of the panel well, and, improving color purity by improving cutting that a peripheral line between the phosphor layer and a black matrix pattern is formed as a straight line in forming the black matrix pattern, by reducing roughness of the inner surface of the panel.

To achieve these and other advantages and in accordance with the purpose of the present invention, as embodied and broadly described herein, there is provided a cathode ray tube having an inner surface with predetermined roughness, including a plurality of black matrix layers formed on the inner surface and a phosphor layer composed of red, green and blue phosphors between the black matrix layers, and the phosphor layer and the black matrix layer are formed on the inner surface of the panel after forming a transparent dielectric film.

Also, to achieve the above object, there is provided a cathode ray tube, including a plurality of black matrix layers formed on an inner surface and a phosphor layer composed of red, green and blue phosphors between the black matrix layers, and the inner and outer surfaces of the panel are substantially flat, the inner surface has predetermined surface roughness, and the phosphor layer is formed on the inner surface of the panel after forming a transparent dielectric film.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
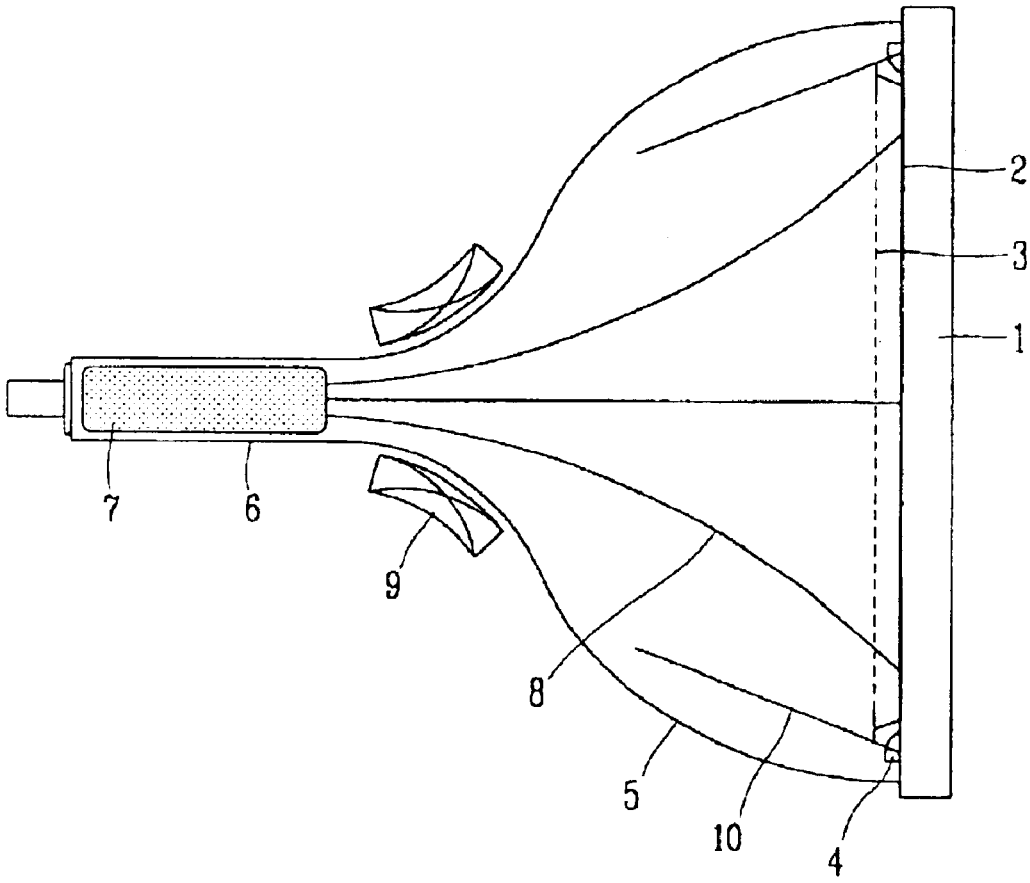
FIG. 1 BACKGROUND ART
FIG. 1 is a schematic view showing a general flat cathode ray tube.
Figure 2:
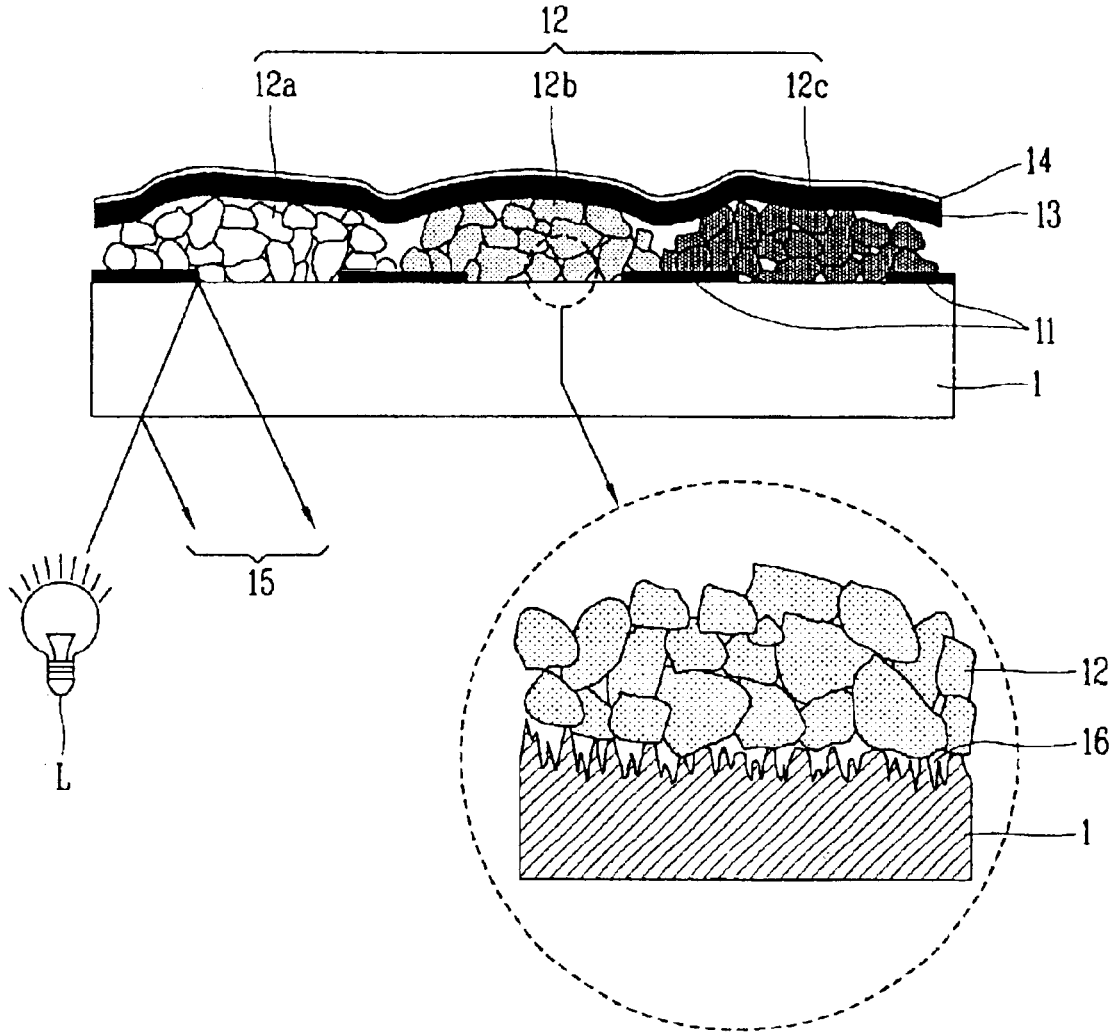
FIG. 2 BACKGROUND ART
FIG. 2 is a cross-sectional view showing structure of a image display device formed on a panel of the conventional cathode ray tube and the partially enlarged cross-sectional view thereof.
Figure 3:
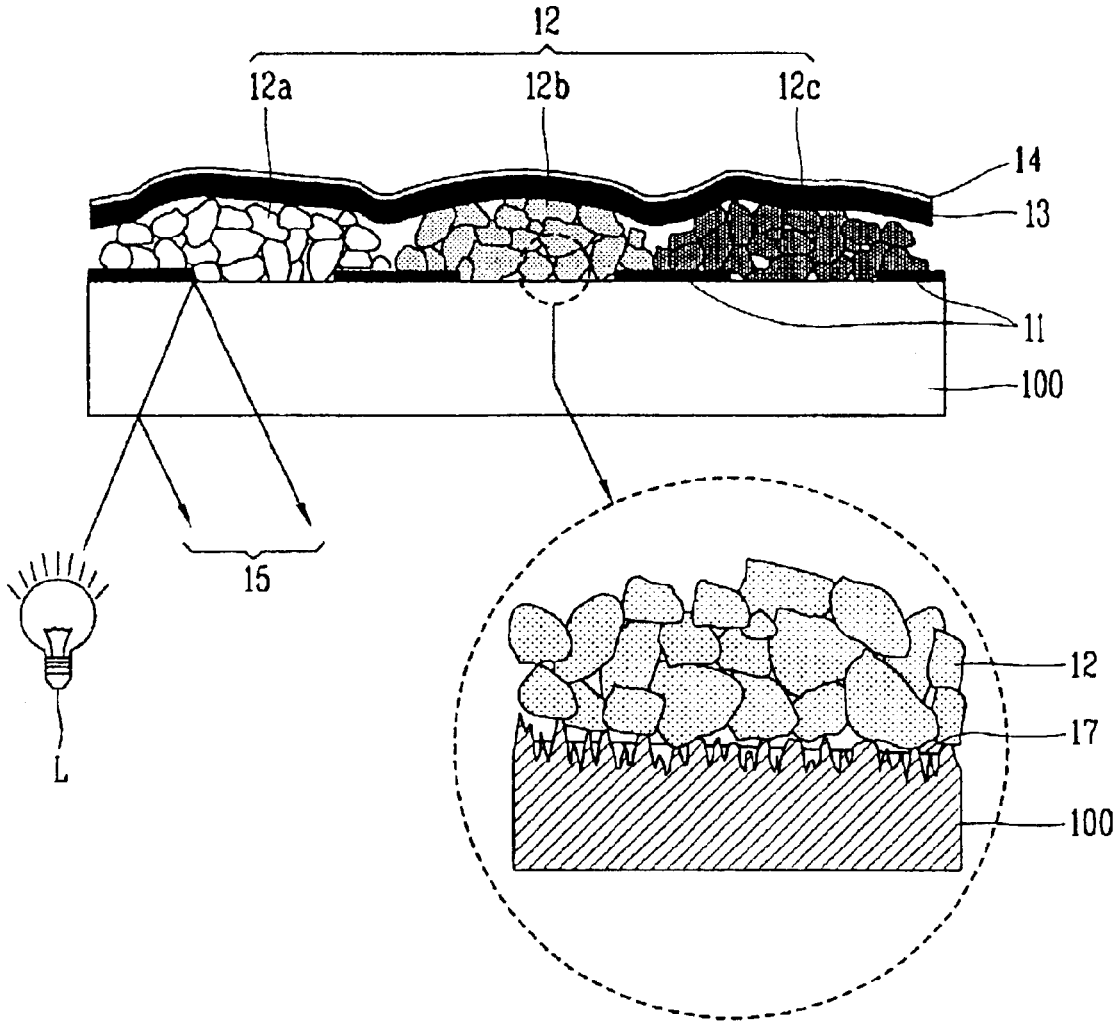
FIG. 3 is a cross-sectional view showing structure of an image display device formed on a panel of a cathode ray tube in accordance with the present invention and the partially enlarged cross-sectional view thereof.

FIG. 3 is a cross-sectional view showing structure of an image display device of a panel of a cathode ray tube in which a transparent dielectric film 17 is formed in accordance with the present invention and the partially enlarged cross-sectional view thereof.

As shown in FIG. 3, the transparent dielectric film 17 is formed between an inner surface of a panel 100 and a phosphor layer 12, and reduces a pore surface 16 between the phosphor layer 12 generated in the section shape of the inner surface of the panel 100 having a valley region at the center and the inner surface of the panel 100.

That is, the inner surface of the panel 100 having flat inner and outer surfaces is mechanically processed by grinding, when measuring the surface roughness by a general mean peak to valley height method, a compound formed by mixing liquid sol containing an organic solvent of alcohol group and silica substance ($SiO_2$) is evenly coated on an entire surface of the inner surface of the panel 100 which is formed to having the roughness value (Rz) of 1.5~2.5 $\mu$m corresponding to the evaluation length of 1 mm under the condition that a temperature of the inner surface of the panel 100 is maintained as 25~35° C. The resultant material is hardened to become a mirror surface at a temperature of 150° C. or higher in a dry kiln, and as shown in FIG. 3, the transparent dielectric film 17 of a silica substance is formed on the whole inner surface of the panel 100.

In the above process, the temperature of the inner surface of the panel 100 relates to a thickness of the transparent dielectric film 17, if the temperature is low, the thickness becomes too thin, and accordingly, quality of the image display device can not be improved. If the temperature is high, the transparent dielectric film 17 can not be uniformly formed on the whole inner surface.

Also, as shown in the enlarged view of FIG. 3, the transparent dielectric film 17 of the silica substance is formed to be filled on the inner surface of the panel having peaks and valleys, putting the valley at the center.

Therefore, after forming the transparent dielectric film 17, the surface roughness of the inner surface of the panel 100 is formed to have a small value Rz in a range of 0.5~2.0 $\mu$m, and the roughness is formed lower than before forming the transparent dielectric film 17.

Figure 4A:
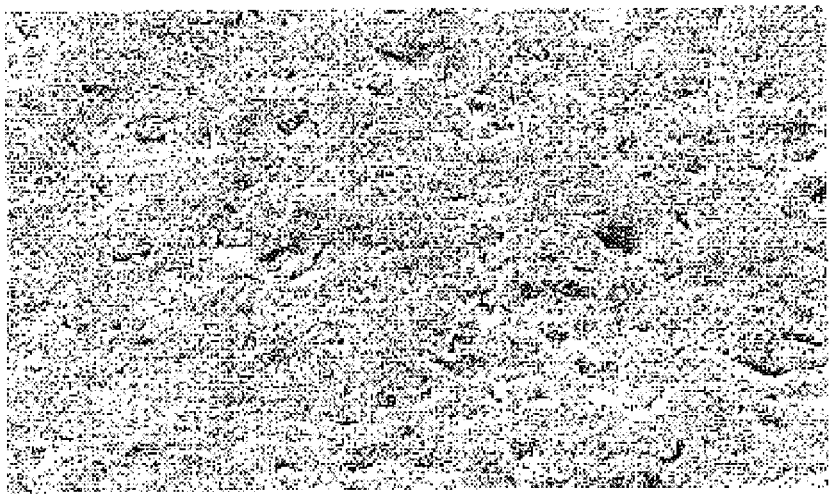
FIG. 4A is an enlarged view showing an inner surface of the panel before forming a transparent dielectric film.
Figure 4B:
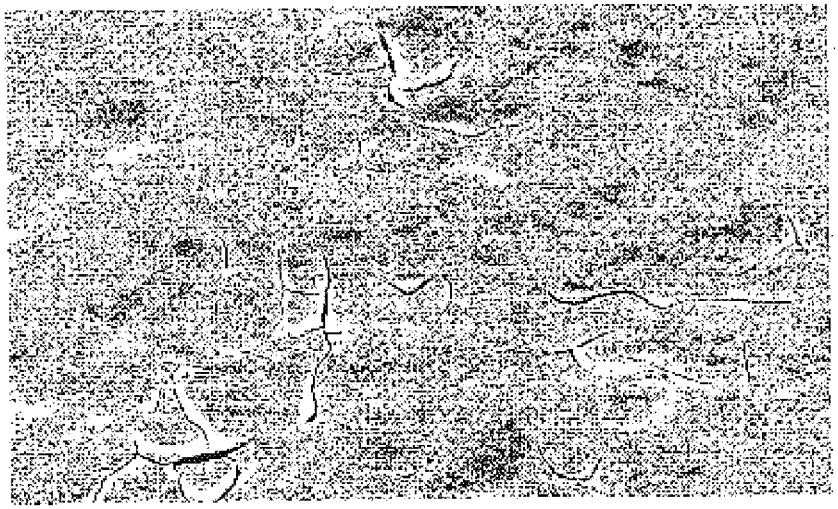
FIG. 4B is an enlarged view showing an inner surface of the panel after forming the transparent dielectric film.
Figure 5A:
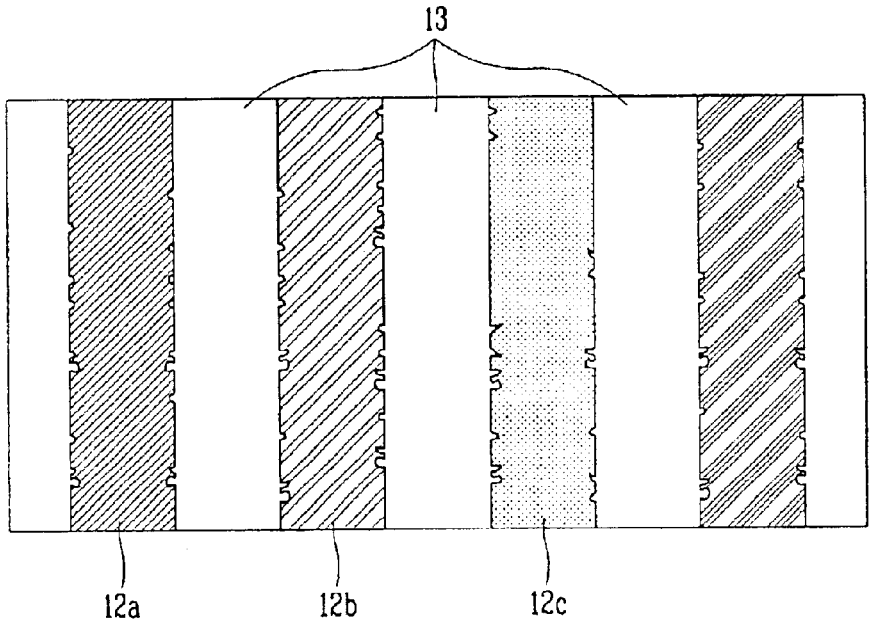
FIG. 5A is a plan schematic view showing cutting of a black matrix pattern before forming the transparent dielectric film.
Figure 5B:
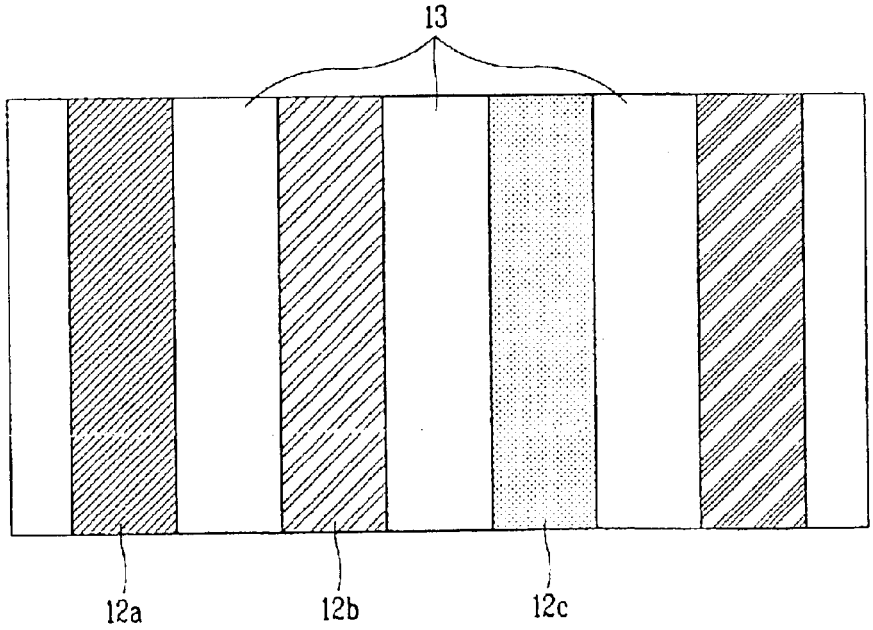
FIG. 5B is a plan schematic view showing cutting of a black matrix pattern after forming the transparent dielectric film.

That is, as shown in FIG. 4A, the shape of the inner surface of the panel 100 was a sharp wave form before forming the transparent dielectric film 17, and after forming the transparent dielectric film 17, the shape is formed as a smooth wave form as shown in FIG. 4B.

Also, in the conventional panel 1, the panel is generally processed to having a surface roughness of 1.5~2.5 $\mu$m by considering the cost and reflection by external light on a peripheral surface between the inner surface of the panel 1 and the phosphor layer 12 when processing the inner surface by grinding. On the other hand, in the present invention, since the transparent dielectric film 17 is formed even if the panel 100 is processed by grinding to have a surface roughness of 3.0~5.0 μm which is higher than the conventional one, degradation of brightness and color purity of the image display device can be prevented.

The thickness of the transparent dielectric film 17 is maintained to be 0.01~1.00 μm after forming.

The reason of the above is that the thickness of the transparent dielectric film 17 can be changed after forming by concentration of the compound containing silica and the rest substances, but in case of lower than a predetermined thickness, it is difficult that the characteristic of the present invention is achieved, and in case of higher than the predetermined thickness, cracks can be generated in the transparent dielectric film 17, as heat expansion coefficients of the panel 100 and the transparent dielectric film 17 are different.

Therefore, if the thickness is not maintained after a predetermined degree, the effect of the present invention can not be achieved.

That is, the thickness of the transparent dielectric film 17 of silica substance must be formed as in following formula 1 according to the roughness of the inner surface of the panel 100 before forming the transparent dielectric film 17 of silica substance to maximize the effect of the present invention.

$$y-0.15<Y<y+0.15 \quad (1)$$

At this time, y=0.1 In(x+1)+0.05 x: surface roughness (μm) of the inner surface of the panel before forming the transparent dielectric film of silica substance (the surface roughness is measured corresponding to a evaluation length of 1 mm by a mean peak to valley height method)

y: optimal thickness (μm) of the transparent dielectric film according to the surface roughness of the inner surface of the panel before processing the transparent dielectric film of silica substance Y: range of the optimal thickness (μm) of the transparent dielectric film according to the surface roughness of the inner surface of the panel before processing the transparent dielectric film of silica substance On the other hand, the refraction index of the panel 100 becomes 1.45~1.70 according to the thickness of the transparent dielectric film 17 after forming the transparent dielectric film of silica substance.

Hereinafter, the effect of the panel of the cathode ray tube in accordance with the present invention will be described.

Firstly, by coating a pore surface 16 between the inner surface of the panel 100 and the phosphor layer 12 formed thereon with a transparent dielectric film 17, in the process of processing the inner surface of the panel 100 using abrasive, the processing can be performed by having surface roughness in a range of 3.0~5.0 μm which is higher than the conventional roughness value (Rz) of 1.5~2.5 μm, thus to reduce grinding cost.

Also, a black matrix patter having a clear peripheral line can be obtained by applying the transparent dielectric film 17 of the present invention having a low roughness, and therefore cutting which means linearity of the black matrix can be improved.

Figure 6:
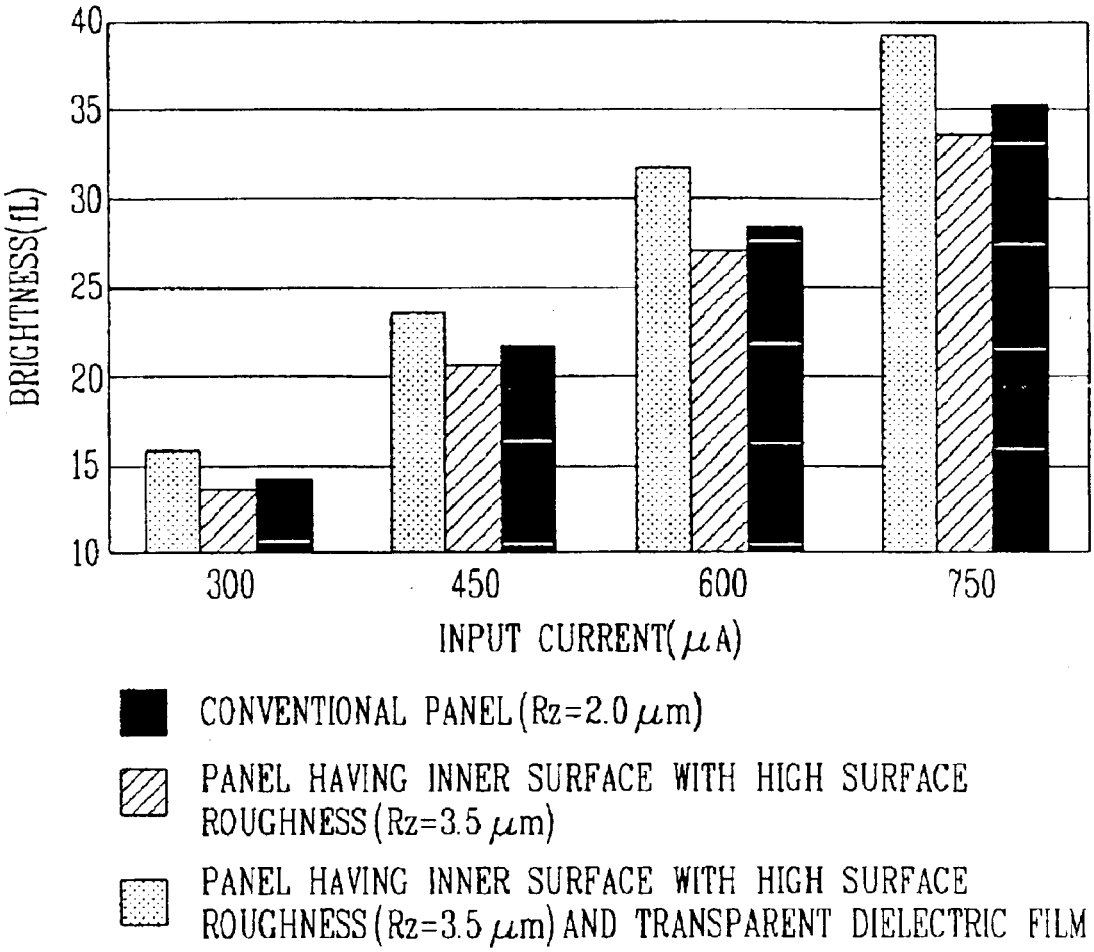
FIG. 6 is a graph showing brightness of an image display device in which a transparent dielectric film is formed by comparing with the brightness of the conventional device.

That is, as shown in FIG. 6, the panel 100 of the present invention in which the transparent dielectric film 17 is formed on the inner surface of the panel 100 having surface roughness of 3.5 μm can have brightness in the image display device about 10% higher than in the general panel 1 which was manufactured by the conventional method having a surface roughness of 2.00 μm.

As shown in the above, the present invention can increase brightness of the image display device by forming the transparent dielectric film on the inner surface of the panel to transmit light of the phosphor layer which emits light to the outside of the panel well, and improve cutting that the peripheral line of the phosphor layer and the black matrix patter is formed as a straight line in case of forming the black matrix pattern by lowering the roughness of the inner surface of the panel.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A cathode ray tube including a panel, said panel having an inner surface with predetermined roughness, a plurality of black matrix layers, and a phosphor layer composed of red, green and blue phosphors between the black matrix layers, wherein the black matrix layers and the phosphor layer are formed on the inner surface of the panel after forming a transparent dielectric film on the inner surface of the panel, wherein a surface roughness of the transparent dielectric film is lower than a surface roughness of the inner surface of the panel before forming the transparent dielectric film.

2. The cathode ray tube of claim 1, wherein the surface roughness of the inner surface of the panel before forming the transparent dielectric film on the inner surface of the panel is 1.5~5.0 μm corresponding to a measuring length of 1 mm when measuring by a mean peak to valley height method.

3. The cathode ray tube of claim 1, wherein a main ingredient of the transparent dielectric film is silica.

4. The cathode ray tube of claim 1, wherein a refraction index of the panel on which the transparent dielectric film is formed is 1.45~1.70.

5. The cathode ray tube of claim 1, wherein a roughness of the inner surface of the panel is 0.5~2.0 μm corresponding to a measuring length of 1 mm when measuring by a mean peak to valley height method after forming the transparent dielectric film on the inner surface of the panel.

6. The cathode ray tube of claim 1, wherein a thickness of the transparent dielectric film formed on the inner surface of the panel is 0.01~1.0 after forming the transparent dielectric film on the inner surface of the panel.

7. The cathode ray tube of claim 1, wherein a thickness of the transparent dielectric film corresponding to a surface roughness of the inner surface of the panel before forming the transparent dielectric film on the inner surface of the panel satisfies the following formula, $$y=0.1\ \ln(x+1)+0.05$$

wherein, x designates the surface roughness of the inner surface of the panel before forming the transparent dielectric film measured by a mean peak to valley height method and y designates a thickness of the transparent dielectric film.

8. The cathode ray tube of wherein the thickness of the transparent dielectric film satisfies the following formula;

$$y-0.15<Y<y+0.15$$

wherein Y designates a range of the thickness of the transparent dielectric film.

9. A panel of a cathode ray tube, comprising:

a plurality of black matrix layers; and a phosphor layer composed of red, green and blue phosphors between the black matrix layers, wherein an inner surface and an outer surface of the panel are substantially flat, the inner surface of the panel has predetermined surface roughness, and the phosphor layer is formed on the inner surface of the panel after forming a transparent dielectric film on the inner surface of the panel, wherein a surface roughness of the transparent dielectric film is lower than a surface roughness of the inner surface of the panel before forming the transparent dielectric film.

10. The panel of a cathode ray tube of claim 9, wherein the surface roughness of the inner surface of the panel before forming the transparent dielectric film on the inner surface of the panel is 1.5~5.0 $\mu$m corresponding to a measuring length of 1 mm when measuring by a mean peak to valley height method.

11. The panel of a cathode ray tube of claim 9, wherein a main ingredient of the transparent dielectric film is silica.

12. The panel of a cathode ray tube of claim 9, wherein a refraction index of the panel on which the transparent dielectric film is formed is 1.45~1.70.

13. The panel of a cathode ray tube of claim 9, wherein a roughness of the inner surface of the panel is 0.5~2.0 $\mu$m corresponding to a measuring length of 1 mm when measuring by a mean peak to valley height method after forming the transparent dielectric film on the inner surface of the panel.

14. The panel of a cathode ray tube of claim 9, wherein a thickness of the transparent dielectric film formed on the inner surface of the panel is 0.01~1.0 $\mu$m after forming the transparent dielectric film on the inner surface of the panel.

15. The panel of a cathode ray tube of claim 9, wherein a thickness of the transparent dielectric film corresponding to a surface roughness of the inner surface of the panel before forming the transparent dielectric film on the inner surface of the panel satisfies the following formula, $$y=0.1\ \ln(x+1)+0.05$$

wherein, x designates the surface roughness of the inner surface of the panel before forming the transparent dielectric film measured by a mean peak to valley height method and y designates a thickness of the transparent dielectric film.

16. The panel of a cathode ray tube of claim 15, wherein the thickness of the transparent dielectric film satisfies the following formula;

$$y-0.15<Y<y+0.15$$

wherein Y designates a range of the thickness of the transparent dielectric film.

* * * * *